US008608861B2

(12) United States Patent
Bertholdt et al.

(10) Patent No.: US 8,608,861 B2
(45) Date of Patent: Dec. 17, 2013

(54) METHOD FOR THE DECONTAMINATION OF AN OXIDE LAYER-CONTAINING SURFACE OF A COMPONENT OR A SYSTEM OF A NUCLEAR FACILITY

(75) Inventors: Horst-Otto Bertholdt, Forchheim (DE); Terezinha Claudete Maciel, Bamberg (DE); Franz Strohmer, Bamberg (DE)

(73) Assignee: Areva NP GmbH, Erlangen (DE)

( * ) Notice: Subject to any disclaimer, the term of this patent is extended or adjusted under 35 U.S.C. 154(b) by 0 days.

(21) Appl. No.: 12/103,286

(22) Filed: Apr. 15, 2008

(65) Prior Publication Data

US 2008/0190450 A1 Aug. 14, 2008

(30) Foreign Application Priority Data

Nov. 29, 2005 (DE) ..... 10 2005 056 727

(51) Int. Cl.
*B08B 7/00* (2006.01)

(52) U.S. Cl.
USPC ..... 134/19; 134/18; 134/26; 134/30

(58) Field of Classification Search
USPC ..... 134/2, 3
See application file for complete search history.

(56) References Cited

U.S. PATENT DOCUMENTS

| | | | | | |
|---|---|---|---|---|---|
| 3,900,551 | A * | 8/1975 | Bardoncelli et al. | ..... | 423/9 |
| 4,287,002 | A * | 9/1981 | Torok | ..... | 134/3 |
| 4,756,768 | A * | 7/1988 | Bertholdt et al. | ..... | 134/3 |
| 4,806,277 | A * | 2/1989 | Sakurai et al. | ..... | 134/2 |
| 5,545,794 | A * | 8/1996 | Bray | ..... | 588/1 |
| 5,958,247 | A | 9/1999 | Bertholdt et al. | | |
| 6,169,221 | B1 | 1/2001 | Milner et al. | | |
| 6,231,683 | B1 * | 5/2001 | Rushton et al. | ..... | 134/28 |
| 2004/0035443 | A1 | 2/2004 | Yaita et al. | | |
| 2004/0224865 | A1 * | 11/2004 | Roeder et al. | ..... | 510/175 |
| 2008/0190450 | A1 | 8/2008 | Bertholdt et al. | | |

FOREIGN PATENT DOCUMENTS

| | | | |
|---|---|---|---|
| EP | 0 160 831 | A2 | 11/1985 |
| EP | 0 727 243 | A1 | 8/1996 |
| EP | 0727243 | A1 | 8/1996 |
| EP | 0 753 196 | B1 | 1/1997 |
| JP | 6285447 | A | 10/1994 |
| JP | 2002066486 | A | 3/2002 |
| JP | 2002-316174 | * | 10/2002 |
| JP | 2010107196 | A | 5/2010 |
| SU | 1273404 | * | 11/1986 |
| WO | 9415001 | A2 | 7/1994 |
| WO | 9853462 | A1 | 11/1998 |
| WO | WO 2004/020347 | * | 3/2004 |

OTHER PUBLICATIONS

International Search Report, dated Jul. 17, 2007.

* cited by examiner

*Primary Examiner* — Eric Golightly
(74) *Attorney, Agent, or Firm* — Laurence A. Greenberg; Werner H. Stemer; Ralph E. Locher

(57) ABSTRACT

The invention relates to a method of decontaminating an oxide layer-comprising surface of a component or a system of a nuclear facility, wherein the oxide layer is treated with gaseous nitrogen oxide ($NO_x$) as oxidizing agent.

18 Claims, 1 Drawing Sheet

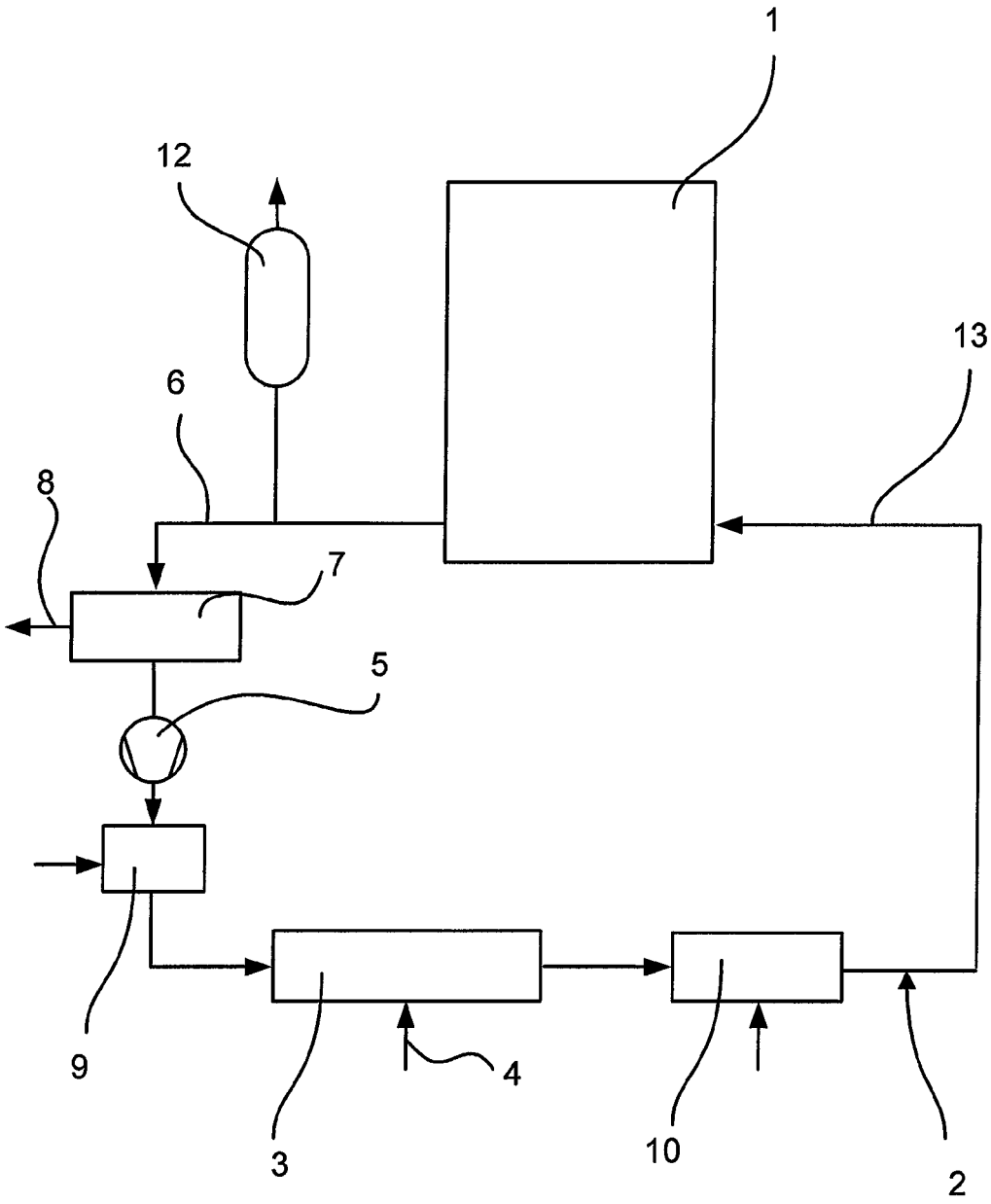
1
12
13
6
8
7
5
9
4
3
10
2

METHOD FOR THE DECONTAMINATION OF AN OXIDE LAYER-CONTAINING SURFACE OF A COMPONENT OR A SYSTEM OF A NUCLEAR FACILITY

CROSS-REFERENCE TO RELATED APPLICATIONS

This is a continuation, under 35 U.S.C. §120, of copending international application PCT/EP2006/010927, filed Nov. 15, 2006, which designated the United States; this application also claims the priority, under 35 U.S.C. §119, of German patent application DE 10 2005 056 727.4, filed Nov. 29, 2005; the prior applications are herewith incorporated by reference in their entirety.

BACKGROUND OF THE INVENTION

Field of the Invention

The invention relates to a method of decontaminating an oxide layer-comprising surface of a component or a system of a nuclear facility. During operation of a light water reactor, an oxidation layer is formed on system and component surfaces and this has to be removed in order, for example, to keep the exposure of personnel to radiation as low as possible in the case of inspection work. A first choice as material for a system or a component is austenitic chromium-nickel steel, for example a steel containing 72% of iron, 18% of chromium and 10% of nickel. Oxide layers having spinel-like structures of the general formula $AB_2O_4$ are formed on the surfaces as a result of oxidation. Chromium always remains in trivalent form, nickel always in divalent form and iron both in divalent and in trivalent form in the oxide structure. Such oxide layers are virtually insoluble in chemicals. The removal or dissolution of an oxide layer for the purposes of decontamination is thus always preceded by an oxidation step in which the trivalent chromium is converted into hexavalent chromium. Here the compact spinel structure is destroyed and iron, chromium and nickel oxides which are readily soluble in organic and mineral acids are formed. An oxidation step is therefore customarily followed by treatment with an acid, in particular a complexing acid such as oxalic acid.

The above-mentioned preoxidation of the oxide layer is customarily carried out in acid solution by means of potassium permanganate and nitric acid or in alkaline solution by means of potassium permanganate and sodium hydroxide. In a method described in the commonly assigned European patent EP 0 160 831 B1 and U.S. Pat. No. 4,756,768, the oxidation is carried out in the acidic range and permanganic acid is used instead of potassium permanganate. The methods mentioned have the disadvantage that manganese dioxide ($MnO_2$) is formed during the oxidative treatment and deposits on the oxide layer to be treated and inhibits penetration of the oxidizing agent (permanganate ion) into the oxide layer. In conventional methods, the oxide layer can therefore not be oxidized completely in one step. Rather, manganese dioxide layers which act as diffusion barrier have to be removed by intermediate reductive treatments. From three to five such reductive treatments are normally necessary, which is associated with a correspondingly large expenditure of time. A further disadvantage of the known methods is the large amount of secondary waste which results, in particular, from the removal of manganese by means of ion exchangers.

In addition to the permanganate oxidation, the literature describes oxidation by means of ozone in aqueous acidic solution with addition of chromates, nitrates or cerium(IV) salts. Oxidation by means of ozone under the conditions mentioned requires process temperatures in the range 40-60° C. However, the solubility and thermal stability of ozone are relatively low under these conditions, so that it is virtually impossible to produce ozone concentrations at an oxide layer which are sufficiently high to break up the spinel structure of the oxide layer within an acceptable time. In addition, the introduction of ozone into large volumes of water is technically complicated. For these reasons, the oxidation by means of permanganate or permanganic acid has become established worldwide despite its disadvantages.

BRIEF SUMMARY OF THE INVENTION

It is accordingly an object of the invention to provide a method of decontaminating an oxide layer-comprising surface of a component or a system of a nuclear facility which overcomes the above-mentioned disadvantages of the heretofore-known devices and methods of this general type and which operates effectively and, in particular, can be carried out in a single stage process.

With the foregoing and other objects in view there is provided, in accordance with the invention, a method of decontaminating an oxide layer-comprising surface of a component or a system of a nuclear facility, which comprises treating the oxide layer with gaseous nitrogen oxide (NOx) as oxidizing agent.

In other words, the objects of the invention are achieved in that the oxidation of the oxide layer is carried out by means of gaseous nitrogen oxide ($NO_x$). Such a procedure has, firstly, the advantage that the oxidizing agent can be applied to the oxide layer in a considerably higher concentration than is possible in the case of an aqueous solution with its limited solvent capability for the oxidizing agent. In addition, the nitrogen oxide is less stable in aqueous solution than in the gas phase. Furthermore, an oxidizing agent present in aqueous solution, for instance the primary coolant of a light water reactor, generally finds a number of substances to react with, so that part of the oxidizing agent is consumed on its way from the introduction point to the oxide layer.

In the case of a completely dry oxide layer, the necessary oxidation reactions, in particular the conversion of chromium (III) into chromium(VI), would proceed slowly. It is therefore advantageous for a film of water to be maintained on the oxide layer during the treatment. The nitrogen oxide ($NO_x$) then finds the aqueous conditions necessary for the oxidation reactions to occur in the film of water covering the oxide layer or in water-filled pores of the oxide layer. In the case of a system which was previously filled with water having been emptied and the gas-phase oxidation being carried out subsequently, the oxide layer is still wetted or thoroughly moistened with water, so that a film of water is already present and at most merely has to be maintained during the gas-phase oxidation. A film of water is preferably produced or maintained by means of steam.

An elevated temperature may be necessary for the desired oxidation reactions to proceed in economically feasible periods of time. A further preferred variant of the method therefore provides for heat to be supplied to the surface of a system or a component or to the oxide layer present thereon, which is effected, for example, by means of an external heating device or preferably by means of hot steam or hot air. In the former case, the desired film of water is at the same time also formed on the oxide layer.

In a further particularly preferred variant of the method, ozone is used as oxidizing agent. In the redox reactions occurring in or on the oxide layer, ozone is converted into oxygen which can be passed without further after-treatment to the exhaust air system of a nuclear facility. In addition, ozone is significantly more stable in the gas phase than in the aqueous phase. Solubility problems as occur in the aqueous phase, particularly at relatively high temperatures, do not occur. The ozone gas can thus be made available in high concentrations to an oxide layer wetted with water, so that the oxidation of the oxide layer, in particular the oxidation of chromium(III) to chromium(VI), proceeds more quickly, especially when the oxidation is carried out at relatively high temperatures.

Not only ozone but also other oxidizing agents have a higher oxidation potential in acidic solution than in alkaline solution. Ozone, for example, has an oxidation potential of 2.08 V in acidic solution, but only 1.25 V in basic solution. In a further preferred variant of the method, acidic conditions are therefore created in the film of water wetting the oxide layer, which can be achieved, in particular, by introduction of nitrogen oxides. Particularly in the case of ozone as oxidizing agent, a pH of from 1 to 2 is maintained. The film of water is preferably acidified by means of gaseous acid anhydrides. These form acids on reaction with water in the film of water.

If the acid anhydrides have an oxidizing action, they can simultaneously be used as oxidizing agent, as is the case in a preferred variant of the method described further below.

As has already been mentioned, the oxidation reactions which occur can be accelerated by employing elevated temperatures. In the case of oxidation by means of ozone, a temperature range of 40-70° C. has been found to be particularly advantageous. The oxidation reactions in the oxide layer proceed at an acceptable rate at and above 40° C. However, an increase in temperature only up to about 70° C. is advantageous since the decomposition of ozone in the gas phase increases appreciably at higher temperatures. The duration of the oxidative treatment of the oxide layer can be influenced not only by the temperature but also by the concentration of the oxidizing agent. In the case of ozone, acceptable reaction rates are achieved within the abovementioned temperature range only above about 5 g/standard $m^3$, and optimal conditions are achieved at concentrations of from 100 to 120 g/standard $m^3$.

In a further preferred variant of the method, mixtures of various nitrogen oxides such as NO, $NO_2$, $N_2O$ and $N_2O_4$ are used for the oxidation. When nitrogen oxides are used, the oxidizing action can also be increased by employing elevated temperatures with such an increase being discernible above about 80° C. The best effectiveness is achieved when the oxidation is carried out in the temperature range from about 110° C. to about 180° C. The oxidizing action can also, as in the case of ozone too, be influenced by the concentration of the nitrogen oxides. An $NO_x$ concentration of less than 0.5 g/standard $m^3$ has barely any effect. Preference is given to using $NO_x$ concentrations of from 10 to 50 g/standard $m^3$.

Before dissolution of the oxide layer present on a component surface is commenced after the oxidative treatment is complete, it is advantageous to rinse the oxide layer which has been treated in the way indicated above, for example with deionized water. However, in a preferred variant of the method, an oxide layer is, after the oxidative treatment, treated with steam, resulting in condensation of the steam occurring on the oxide layer. For steam to be able to condense, it may be necessary to cool the component surfaces or an oxide layer present thereon to a temperature below 100° C. It has surprisingly been found that as a result of this treatment, activity adhering in or on the oxide layers or component surfaces, for instance in particle form or in dissolved or colloidal form, goes over into the condensate and is removed from the surfaces together with this. This effect is clearly apparent at steam temperatures above 100° C. A further advantage of this procedure is the comparatively small amount of liquid condensate obtained.

Excess steam, i.e. steam which has not condensed on the treated surfaces, is removed from the system to be decontaminated or a container in which an oxidative treatment has been carried out and condensed. It is passed together with the condensate running off a component surface over a cation exchanger. In this way, the condensate is freed of activity and can be disposed of without problems. However, a further treatment carried out beforehand can be advantageous, especially when nitrate ions originating from the oxidative treatment of an oxide layer or acidification of a film of water by means of nitrogen oxides are present. The nitrates are preferably removed from the condensate by reacting them with a reducing agent, in particular hydrazine, to form gaseous nitrogen. A molar ratio of nitrate to hydrazine of from 1:0.5 to 2:5 is advantageously set here.

Other features which are considered as characteristic for the invention are set forth in the appended claims.

Although the invention is illustrated and described herein as embodied in "method for the decontamination of an oxide layer-containing surface of a component or a system of a nuclear facility, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE SEVERAL VIEWS OF THE DRAWING

The sole FIGURE of the drawing is a flow diagram illustrating the method of decontamination according to the invention.

DETAILED DESCRIPTION OF THE INVENTION

Referring now to the drawing FIGURE in detail, a system 1 to be decontaminated may, for example, be the primary circuit of a pressurized water reactor. First, the primary circuit is emptied. In the case of the decontamination of a component, for example a primary system pipe, the same is placed in a container. Such a container would correspond to the system 1 in the flow diagram. A decontamination circuit 2 is connected to the system 1 or the container. This circuit is gastight. Before startup, the decontamination circuit 2 and the system are tested for leaks, for example by evacuation. As a next step, the entire plant, i.e. system 1 and decontamination circuit 2, is heated. For this purpose, a feed station 3 for hot air and/or hot steam is arranged in the decontamination circuit 2. Air and/or steam are fed in via a feed line 4. The decontamination circuit 2 is also provided with a pump 5 in order to fill the system 1 with the appropriate gaseous medium and circulate the same, as required, through the entire plant. The system is brought to the intended process temperature, in the case of ozone to 50-70° C., by means of hot air or hot steam. To produce a film of water on the oxide layer of the system 1 or a system component present in a container, steam is introduced via the feed station 3. Water which precipitates or condenses is separated off at the outlet from the system 6 by way of a liquid separator 7 and removed from the decontamination circuit 2 by way of a condensate line 8. To accelerate the Cr(III)/Cr(VI) oxidation, the water film wetting the oxide layer to be oxidized is acidified. For this purpose, gaseous nitrogen oxides or atomized nitric acid is introduced at a feed station 9 in the decontamination circuit 2.

The nitrogen oxides dissolve in water to form the corresponding acids, for instance to form nitric or nitrous acid. The amounts of $NO_x$ or nitric/nitrous acid introduced are selected so that a pH of from about 1 to 2 is established in the film of water. As soon as the required process parameters, i.e. desired temperature of the system or an oxide film present on a surface, presence of a film of water and degree of acidity of the film of water, have been reached, ozone is introduced continuously into the system 1 in a concentration in the range of preferably from 100 to 120 g/standard $m^3$ via a feed station 10 while the pump 5 is in operation. If necessary, in parallel to the introduction of ozone, $NO_x$ (or else $HNO_3$) is fed in continuously to maintain the acidic conditions in the film of water and hot air or hot steam is fed in to maintain the intended temperature. At the outlet from the system 6, part of the gas/vapor mixture present in the decontamination circuit 2 is discharged so that fresh ozone gas and, if appropriate, other auxiliaries such as $NO_x$ can be introduced, with the amount discharged corresponding to the amount of gas introduced. Discharge occurs via a gas scrubber to remove $NO_x$/$HNO_3$/$HNO_2$ and subsequently via a catalyst 12 in which ozone is converted into oxygen. The ozone-free oxygen/air mixture which possibly still contains steam is passed to the exhaust system of the power station. During the oxidative treatment, the ozone concentration is measured in the system recycle stream 13 by means of strategically placed probes. The temperature is monitored by means of appropriate sensors arranged in the region of the system 1. The amount of $NO_x$ introduced depends on the amount of steam fed in. At least 0.1 g of $NO_x$ is fed in per standard $m^3$ of steam and a pH of the film of water of <2 is ensured thereby.

When the Cr(III) present in an oxide layer has been converted to at least a substantial extent into Cr(VI), the introduction of ozone, $NO_x$ and hot air is stopped and a rinsing step is commenced. For this purpose, the oxide layer is preferably treated with steam and care is taken to ensure that the component surfaces or an oxide layer present thereon have a temperature of less than 100° C. so that the steam can condense thereon. As mentioned above, activity present in or on the oxide layer is removed by this treatment. In addition, the respective surfaces are rinsed free of acid residues, mainly nitrates. These have been formed in the oxidative treatment of an oxide film or in the acidification of an oxide film present on an oxide layer by reaction of the nitrogen oxides used for this purpose with water. After the rinsing step carried out by means of steam, an aqueous solution containing nitrate and radioactive cations is obtained. The nitrate is firstly converted into gaseous nitrogen by means of a reducing agent, with the best results having been achieved when using hydrazine, and thus removed from the condensate solution. To remove the nitrate completely, a stoichiometric amount of hydrazine is preferably used, i.e. a molar ratio of nitrate to hydrazine of 2:5 is set. The active cations are removed next by passing the solution over a cation exchanger.

Rinsing of an oxidatively treated oxide layer can naturally also be carried out by filling the system 1 with deionized water. When the system is filled, the displaced gas is conveyed over the catalyst 12 and the residual ozone present therein is reduced to $O_2$ and, as indicated above, the gas is passed to the exhaust system of the nuclear power station. The nitrate ions present on the surface of the components to be decontaminated or the oxide layer still present there, which have been formed by introduction of nitric acid or by oxidation of $NO_x$, are taken up by the deionized water and remain in the decontamination solution during the subsequent treatment for dissolving the oxide layer. An organic complexing acid, preferably oxalic acid, is added to the decontamination solution for the stated purpose at a temperature of, for example, 95° C., for instance according to the method described in the above-mentioned European patent EP 0 160 831 B1 and U.S. Pat. No. 4,756,768. Here, the decontamination solution is circulated in the decontamination circuit 2 by means of the pump 5, with part of the solution being conveyed via a side connection (not shown) over ion-exchange resins and cations dissolved from the oxide layer being bound on the exchange resins. At the end of the decontamination, an oxidative decomposition of the organic acid into carbon dioxide and water is carried out by means of UV irradiation as a final step, for instance according to the method described in the commonly assigned European patent EP 0 753 196 B1 and U.S. Pat. No. 5,958,247.

In a laboratory experiment, a gas-phase oxidation was carried out on a pipe section in a primary system pipe. An experimental setup corresponding to the accompanying flow diagram was used for this purpose. The pipe originated from a pressurized water facility which had been in operation to generate power for more than 25 years and was provided with internal plating of austenitic Fe—Cr—Ni steel (DIN 1.4551). The oxide formation present on the interior surface of the pipe was accordingly dense and difficult to dissolve. In a second laboratory experiment, the oxide layer of steam generator tubes which consisted of Inconel 600 and had been in operation to generate power for 22 years was preoxidized by means of ozone in the gas phase. Comparative experiments for both the first and second laboratory experiments were carried out using permanganate as oxidizing agent. In further experiments, original specimens from a pressurized water facility which had been in operation to generate power for 3 years were subjected only to an $NO_x$ gas-phase oxidation. The results are summarized in tables 1, 2, and 3 below. The term "cycle" used in the tables means 1 preoxidation step and 1 decontamination step.

TABLE 1

Decontamination of austenitic Fe/Cr/No steel plating (DIN 1.4551) from a primary pipe of a pressurized water reactor.

| Decontamination method | Preoxidation step - Total treatment time [h] | Decontamination step - Total treatment time [h] | DF |
|---|---|---|---|
| Decontamination method based on permanganate + oxalic acid 3 cycles, temp. 90-95° C. | 40-60 | 20 | 10-17 |
| Decontamination method based on ozone/$NO_x$ gas phase 1 cycle, temp. 50-55° C. | 12 | 6 | 300-400 |

TABLE 2

| Decontamination of PWR/steam generator pipes made of Inconel 600 | | | |
|---|---|---|---|
| Decontamination method | Preoxidation step - Total treatment time [h] | Decontamination step - Total treatment time [h] | DF |
| Decontamination method based on permanganate + oxalic acid 3 cycles, temp. 90-95° C. | 40-60 | 20 | 3-8 |
| Decontamination method based on ozone/$NO_x$ gas phase 1 cycle, temp. 50-55° C. | 6 | 6 | 30-60 |

TABLE 3

| Original specimen from a PWR (material No. 1.4550, 3 years of operation to generate power). | | |
|---|---|---|
| Decontamination method | Total treatment time | DF |
| Decontamination method based on permanganate + oxalic acid 3 cycles, temp. 90-95° C. | 36 hours | 20-35 |
| $NO_x$ treatment 1 cycle, temp. 150-160° C. | 12 hours | 100-280 |

It can be seen that in the case of the gas-phase oxidation using ozone a considerably shorter treatment time at a lower temperature was necessary than in the case of a preoxidation by means of permanganate. In addition, it has surprisingly been found that the decontamination phase following the preoxidation, in which the pretreated oxide layer was dissolved by means of oxalic acid, could likewise be carried out in a significantly shorter time. A further surprising result was that significantly higher decontamination factors (DF) can be achieved in a procedure according to the invention. Since the after-treatment in the experiments and their corresponding comparative experiments was the same in each case, this result can only be interpreted as resulting from the preoxidation in the gas phase. This obviously opens up an oxide film in such a way that the subsequent dissolution of the oxide layer by means of oxalic acid or another complexing organic acid occurs considerably more easily.

Comparable results (see table 3) were achieved in the case of a preoxidation using only $NO_x$ as oxidizing agent.

The invention claimed is:

1. A method of decontaminating a surface in a nuclear facility, the surface having an oxide layer thereon, the method which comprises:

producing a film of water on the surface having the oxide layer, the film of water being produced from steam; and treating the oxide layer with a gas selected from the group consisting of nitrogen monoxide, nitrogen dioxide, and combinations thereof as an oxidizing agent while maintaining the film of water on the surface, and causing the oxide layer on the surface to oxidize while the film of water is maintained on the surface during an entire oxidation reaction.

2. The method according to claim 1, which comprises supplying heat to the surface or the oxide layer on the surface.

3. The method according to claim 2, wherein the heat is supplied by way of steam or air.

4. The method according to claim 2, wherein the heat is supplied by way of an external heating device.

5. The method according to claim 1, which comprises heating the surface to a temperature of at least 80° C.

6. The method according to claim 5, which comprises heating the surface to a temperature of from 110° C. to 180° C.

7. The method according to claim 1, which comprises maintaining a NOx concentration of at least 1 g/standard $m^3$ during the treating step.

8. The method according to claim 7, wherein the NOx concentration is from 10 to 50 g/standard $m^3$.

9. The method according to claim 1, which comprises treating the surface with steam after the step of treating the oxide layer with the gas, and causing condensation of the steam on the surface.

10. The method according to claim 9, wherein a temperature of the steam is greater than 100° C.

11. The method according to claim 10, which comprises condensing excess steam to form a condensate.

12. The method according to claim 11, which comprises passing the condensate over a cation exchanger.

13. The method according to claim 11, which comprises treating the condensate with a reducing agent to remove nitrate present therein.

14. The method according to claim 13, wherein the reducing agent is hydrazine.

15. The method according to claim 14, which comprises setting a molar ratio of nitrate to hydrazine to at least 1:0.5.

16. The method according to claim 15, wherein the molar ratio of nitrate to hydrazine lies in a range from 1:0.5 to 2:5.

17. The method according to claim 1, which comprises, subsequently to the charging and producing steps, treating the oxide layer with an aqueous solution of an organic acid.

18. The method according to claim 17, wherein the organic acid is oxalic acid.

* * * * *